United States Patent [19]

Cochran et al.

[11] 4,044,089

[45] Aug. 23, 1977

[54] PROCESS AND APPARATUS FOR PRODUCING THICK AND THIN FILAMENTS

[75] Inventors: Stanley Robert Cochran, Harrisonburg; Oren Hardin Davis, Axton, both of Va.

[73] Assignee: E. I. Du Pont de Nemours and Company, Wilmington, Del.

[21] Appl. No.: 686,644

[22] Filed: May 13, 1976

[51] Int. Cl.[2] ..... D02J 1/22; B29C 17/02

[52] U.S. Cl. ..... 264/167; 28/243; 264/290 N

[58] Field of Search ..... 28/71.3, 59.5; 57/55.5; 264/290 R, 290 N; 290 T, 167; 425/76

[56] References Cited

U.S. PATENT DOCUMENTS 2,847,703 8/1958 Schrenk et al. ..... 264/290 R 3,311,691 3/1967 Good ..... 264/290 N

FOREIGN PATENT DOCUMENTS 42-27563 12/1967 Japan ..... 28/71.3

*Primary Examiner*—Louis K. Rimrodt

[57] ABSTRACT

A process and apparatus for producing thick and thin filaments wherein the deniers of the thick portions of the filaments are randomized by passing an undrawn nylon feed yarn from a supply package under tension through the nip in a feed/cott roll combination, the cott roll having at least one peripheral slot periodically opening the nip. The yarn is forwarded from this nip by a draw roll assembly operated at a peripheral velocity of 3–5X that of the feed roll to fully draw the drawn portions. A snubbing device is used upstream of the feed/cott roll assembly to provide a yarn tension immediately upstream of the nip.

2 Claims, 3 Drawing Figures

PROCESS AND APPARATUS FOR PRODUCING THICK AND THIN FILAMENTS

BACKGROUND OF THE INVENTION

This invention relates to the production of yarns having thick and thin sections. More particularly it relates to process and apparatus for preparing nylon filament yarns having thick and thin sections.

The production of thick and thin yarns is known in the art. For example, Nicita et al., U.S. Pat. No. 3,491,418, utilizes a cott roll with a plurality of series of slots of different length and traverses the yarn across this series. The thin (fully drawn) portions of each filament have substantially constant denier and the same is true for the thick (undrawn or partially drawn) portions. In order to avoid patterning when these yarns are used in textile fabrics a randomness of the alternating thick and thin filaments is required. The randomness apparently obtained by Nicita et al. is a variation in lengths of the thick and the thin sections.

SUMMARY OF THE INVENTION

It has now been found that an improvement in the randomness obtained by the prior art can be obtained by randomly varying the denier of the thick sections of the thick and thin yarns thus avoiding patterning in textile fabrics without having to provide a variation in the lengths of the thick and thin sections. The process includes the steps of passing an undrawn nylon feed yarn from a supply package while under tension into the nip of a feed roll assembly comprising rotating driven feed and presser rolls, the presser roll having at least one peripheral slot periodically opening the nip whereby the presser and feed rolls intermittently engage the yarn between them and forward it then release the yarn when the slot is over the filament. The filament is continuously removed from the nip under tension by a draw roll assembly operated at a peripheral velocity of 3–5X that of the feed roll assembly to fully draw the drawn portions and then collected. The yarn passes only once through the nip along a path substantially tangential to the feed roll surfaces. Both entering and leaving the nip the filament is in a single plane. A snubbing device is used upstream of the feed roll assembly to provide yarn tension immediately upstream of the nip which is in the range of from 0.005 to about 0.015 grams per denier based on the denier of the undrawn yarn or filament. The yarn is also snubbed between the feed and draw rolls for localizing the draw point.

DETAILED DESCRIPTION OF THE PREFERRED EMBODIMENT

Figure 1:
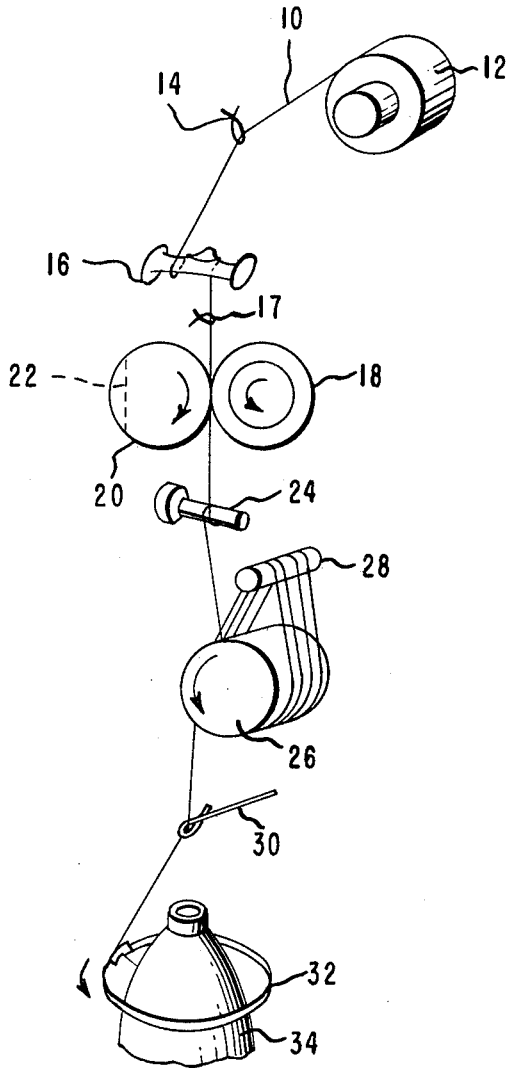
FIG. 1 is a diagrammatic representation of a preferred embodiment of the process and apparatus for preparing the yarn of this invention.

The drawings show a yarn 10 being withdrawn from a supply package 12 through a pigtail guide 14 and around a snub guide 16 to the feed roll assembly comprising feed roll 18 and cott or presser roll 20. The feed roll 18 is driven in the direction shown by the arrow by a conventional drive means (not shown). The presser roll 20 is provided with a slot 22 and is driven by engagement with roll 18.

Figure 2:
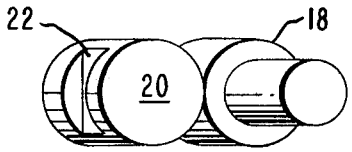
FIG. 2 is a perspective view of the feed roll assembly of FIG. 1.

Slot 22 of presser roll 20 is shown more clearly in FIG. 2. It extends along the surface of the presser roll from about 10% to about 40% of the circumference and allows the yarn to deliver directly with nip disengaged from the friction guide 16 to draw pin 24 with negligible contact and friction when it is over the yarn in the nip. At other times the presser roll is pressing against the feed roll and engages the yarn passing through the nip. The yarn then slows to feed roll speed and is drawn. Yarn 10 passing from the tangency of the rolls 18 and 20 then passes over a draw pin 24 to draw roll 26 and over associated idler roll 28. Yarn 10 leaving draw roll passes through a guide 30 and then on to windup mechanism 32 and package 34.

Operation of this process with a given cake of undrawn yarn provides a drawn thick/thin yarn which varies in skein denier over a limited but definite range. Since the thin portions have substantially constant denier the variation is attributable to variation in deniers of the thick portions both within a package and among packages.

While the invention applies equally to monofilament and multifilament yarns and may be superimposed on alternate length randomness of the prior art, it is best exemplified by using a 6,6 nylon filament for which nip disengagement times producing thick sections alternate with nip engagement times producing thin sections with the nip engagement times being greater than the nip disengagement times.

The monofilament feed yarn is generally from 100 to 200 denier filament. The tension guide 16 may be of a pin variety. However, it is preferred that it be of such configuration as to contain the filament 10. The presser roll 20 may have a rubber surface while the feed roll may have a metal surface. The draw ratio will, of course, be determined by the respective speeds of the draw and feed rolls. For this process and with nylon 6,6 it will generally range from about 3.2 to 5. The degree to which the thick portions become drawn has been found to vary substantially all the way from essentially undrawn to almost completely drawn.

EXAMPLE

A 6,6 nylon flake having a RV of 36 is used to spin a monofilament. RV is solution-to-solvent ratio of absolute viscosities at 25° C when the solvent is aqueous 90% formic acid and the solution has 8.4% by weight polymer. The monofilament is spun at 276 ± 2 yd/min (252 ± 2 m/min) and wound onto spin cakes containing about 2.4 lb (1.1 kg) of undrawn monofilament. Denier of the undrawn monofilament is about 111.

The undrawn monofilament on its package is stocked on a creel and processed substantially as shown in FIG. 1. Because the feed action is so erratic, the spin bobbin is mounted in a loosely fitting can with an Alsimag eyelet guide, i.e., 14, for its exit opening. Then the yarn makes 1.25 turns around the snubbing guide 16 which is a ¾-inch (1.9 cm) diameter cylindrical guide with 30–40 μ AA surface roughness, with discs at each end to prevent loss of yarn and with a post of guide material extending from the middle of the cylindrical guide for separating individual wraps. The post is located 10 degrees from vertical. The yarn then tangentially enters and leaves the nip between the driven feed roll 18 and follower cott roll 20. The cott-roll 20 is a hard-rubber roll 3-7/16-inch (8.73 cm) in diameter. It has a one-inch (2.54 cm) wide slot centered on its face to remove ⅛ of the roll circumference. Between the snubbing guide and the feed-roll, another Alsimag eyelet guide 17 is positioned to make sure the yarn enters the nip tangentially. Departing the nip, the yarn makes two wraps around a cylindrical 0.195 inch (0.495 cm) diameter draw pin 24 with an AA surface roughness of 20–30 μ. At least one wrap is required both for localizing the draw point and for isolating the drawing tension from the feed/cott roll assembly. Peripheral velocity of the draw roll is 701 yd/min (641 m/min) to provide a draw ratio (for the fully drawn segments) of 4.285X. The drawn thick-thin monofilament is wound onto pirns using a standard ring-and-traveller windup.

Figure 3:
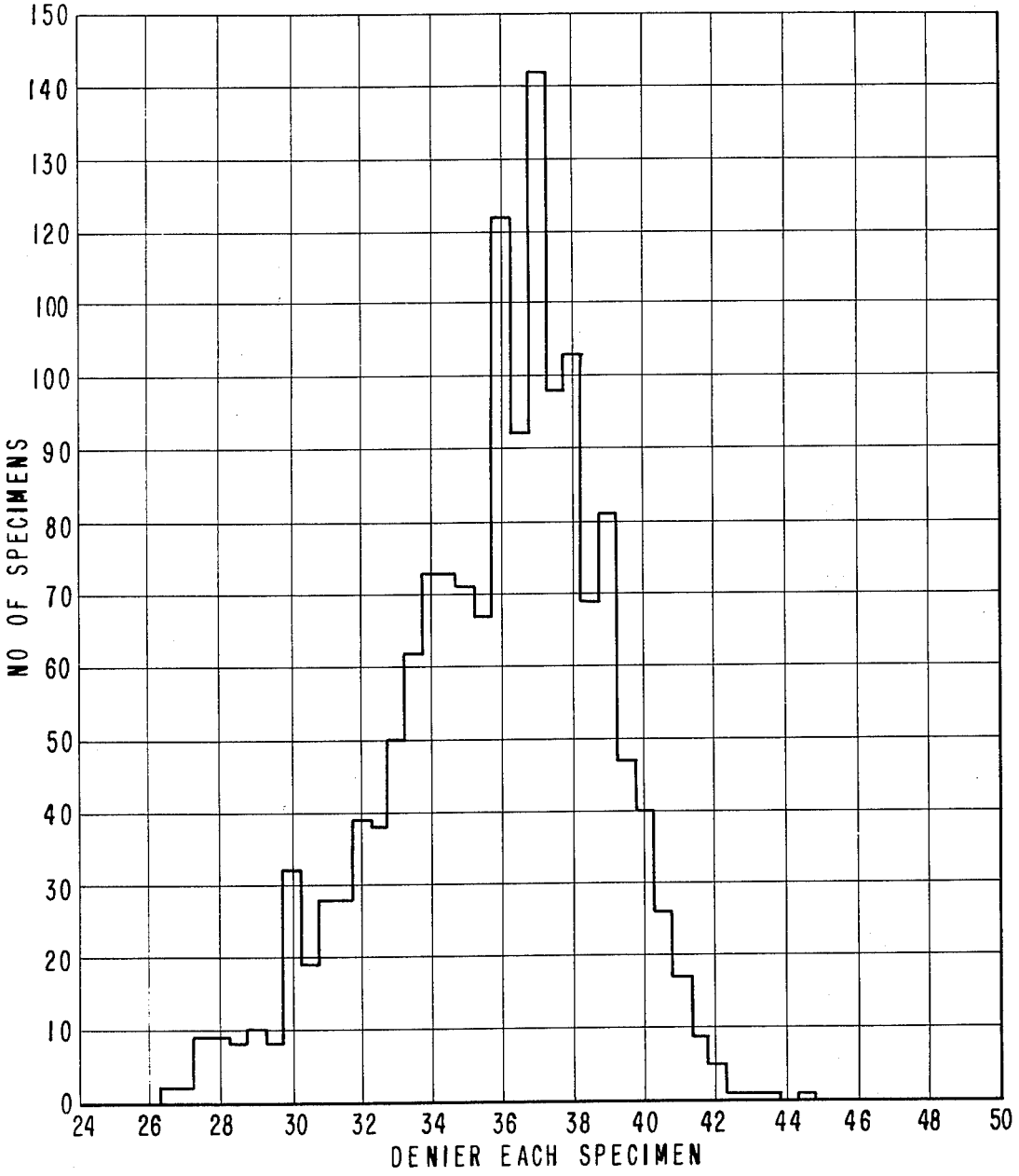
FIG. 3 is a graph which is a histogram of the denier distribution representative of a product produced by this invention.

FIG. 3 represents 1483 separate denier determinations of random samples taken from the yarn produced during a prolonged test under the above conditions. The denier ranged from a minimum of 26.6 to a maximum of 44.5. The mean denier was about 36.

Skein denier is determined by weighing a 90 meter length of yarn then converting to the weight in grams of 9000 meters.

What is claimed is:

1. An apparatus for continuously drawing an undrawn filament to produce thick and thin sections along its length comprising: a feed roll assembly at the input end of a drawing field and a draw roll assembly at the output end of said field, the said feed roll assembly comprising a presser roll and a driven roll, the presser roll having a depression in the surface extending from about 10% to about 40% of its circumference, the presser and driven rolls being positioned to form a nip and to engage the filament between them and to forward it as they rotate and to release the filament as the depression passes the position of tangency of the rolls; means cooperating with and preceding said feed roll assembly for tensioning the filament in the range of from about 0.005 to about 0.015 grams per denier and then directing the filament directly to the nip of the two rolls; means associated with said draw roll assembly and located between the feed and draw roll assemblies to tension and direct the filament from the nip, the said nip and the means directing the filament to and from the nip all lying in the same plane so that the filament wraps neither the presser nor the driven roll, and means for winding the filament onto a package.

2. A process for continuously drawing an undrawn filament to produce thick and thin sections along its length comprising: passing the filament while under a tension of from about 0.005 to about 0.015 grams per denier into the nip of a feed roll assembly comprising rotating driven presser and feed rolls; removing said filament from said nip under tension, the filament being in a single plane as it enters, passes through and exits the nip; drawing the filament and collecting the filament, the said presser roll having a depression extending over from about 10 to about 40% of its circumference, whereby the presser and driven rolls intermittently engage the filament between them and forward it and then release the filament when the depression of the presser roll is over the filament.

* * * * *